US007553107B2

(12) United States Patent
Espinasse

(10) Patent No.: US 7,553,107 B2
(45) Date of Patent: Jun. 30, 2009

(54) LIQUID STORAGE INSTALLATION

(75) Inventor: Philippe Espinasse, Bihorel (FR)

(73) Assignee: Technip France (FR)

( * ) Notice: Subject to any disclaimer, the term of this patent is extended or adjusted under 35 U.S.C. 154(b) by 245 days.

(21) Appl. No.: 10/540,044

(22) PCT Filed: Dec. 22, 2003

(86) PCT No.: PCT/FR03/03871

§ 371 (c)(1),
(2), (4) Date: Jan. 12, 2007

(87) PCT Pub. No.: WO2004/059205

PCT Pub. Date: Jul. 15, 2004

(65) Prior Publication Data

US 2007/0140795 A1 Jun. 21, 2007

(30) Foreign Application Priority Data

Dec. 23, 2002 (FR) ..... 02 16567

(51) Int. Cl.
*E02D 27/38* (2006.01)

(52) U.S. Cl. ..... 405/210

(58) Field of Classification Search ..... 405/210
See application file for complete search history.

(56) References Cited

U.S. PATENT DOCUMENTS 3,675,431 A * 7/1972 Jackson ..... 405/210
3,791,152 A * 2/1974 Davis et al. ..... 405/210
3,828,565 A * 8/1974 McCabe ..... 405/210
3,898,846 A * 8/1975 McCabe ..... 405/210
3,913,335 A * 10/1975 Heien ..... 405/210
4,155,671 A * 5/1979 Vos ..... 405/203
4,183,221 A 1/1980 Yamamoto ..... 62/45
4,188,157 A * 2/1980 Vigander ..... 405/210
4,302,130 A * 11/1981 Mo ..... 405/210
4,402,632 A * 9/1983 Cook ..... 405/210
4,422,804 A * 12/1983 Gerwick et al. ..... 405/210
4,556,343 A * 12/1985 Cheung ..... 405/210
5,044,830 A * 9/1991 Barbaras et al. ..... 405/210
5,468,089 A 11/1995 Claude et al. ..... 405/52

FOREIGN PATENT DOCUMENTS

GB 2 017 592 10/1979

OTHER PUBLICATIONS

International Search Report PCT/FR03/03871 dated Jun. 22, 2004.

* cited by examiner

*Primary Examiner*—Frederick L Lagman
(74) *Attorney, Agent, or Firm*—Ostrolenk, Faber, Gerb & Soffen, LLP

(57) ABSTRACT

An underwater storage installation for a cryogenic liquid. A foundation base rests directly on the sea floor. An underwater cell for storing the cryogenics liquid and cryogenic liquid-supply and -discharge conduits. The storage cell comprises a sealed outer chamber and a vapor barrier disposed inside the outer chamber and which defines a watertight space. A separation space is disposed between the outer chamber and the vapor barrier. Spacers are disposed in the space to keep the chamber and the vapor barrier at a distance from one another. The installation can be used for the storage of liquefied natural gas.

14 Claims, 5 Drawing Sheets

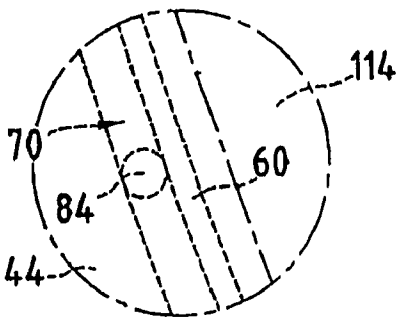
FIG.5A
FIG.5
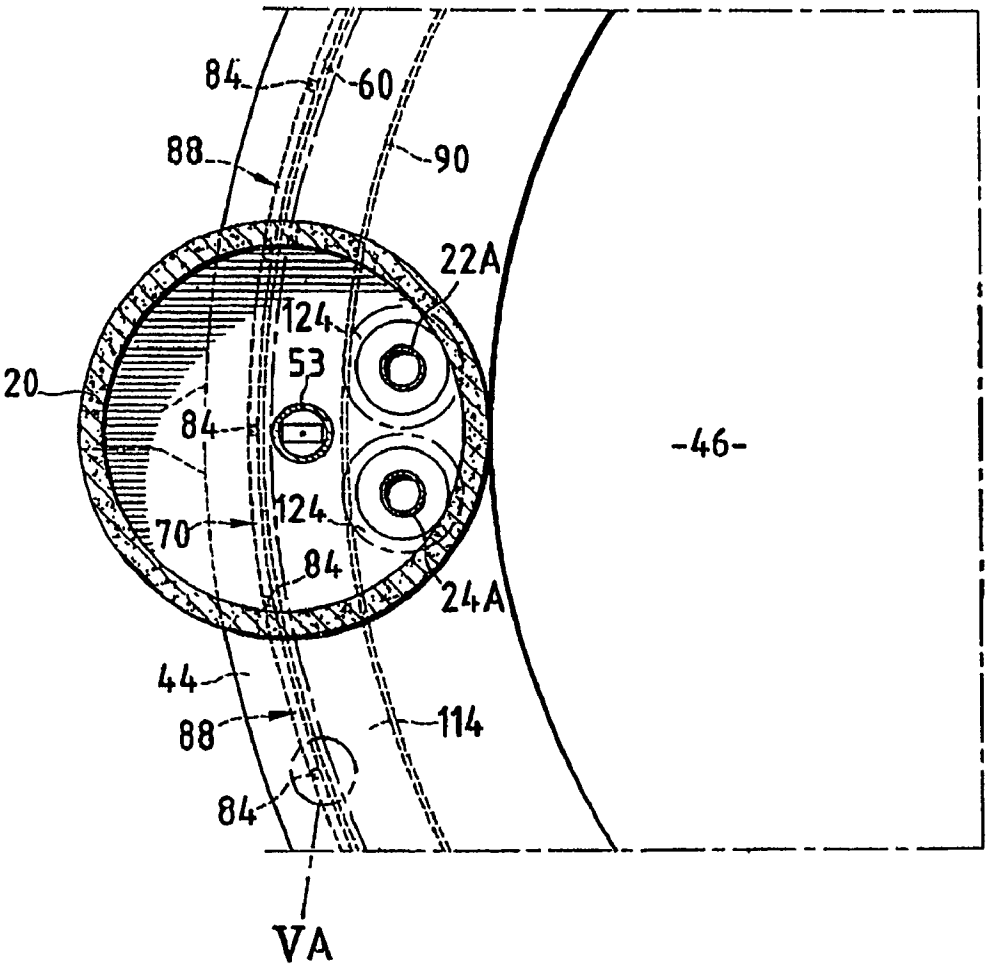

LIQUID STORAGE INSTALLATION

CROSS REFERENCE TO RELATED APPLICATION

The present application is a 35 U.S.C.§§371 national phase conversion of PCT/FR2003/003871, filed 22 Dec. 2003, which claims priority of French Application No. 02 16567, filed 23 Dec. 2002. The PCT International Application was published in the French language.

The present patent application relates to an underwater storage installation for storing a cryogenic liquid as defined in the preamble of claim 1.

Installations for storing liquefied natural gas on land are known.

Such installations comprise storage cells having an outer enclosure made of concrete, within which there is placed a self-supporting liquefied natural gas storage tank made of special steels (9% nickel, stainless steel).

A space is formed between the walls of the outer enclosure and the storage tank so as to accommodate the thermal insulation. This insulation may for example be perlite, glass foam, etc. This space enables the heat losses between the external atmospheric surroundings, the temperature of which may be between −25° C. and +50°, and the liquefied natural gas whose temperature is −163° C., to be minimized. The dimensions of this annular space are generally of the order of one meter.

Such a tank is not directly suited to underwater use because the concrete enclosure of the storage cell is not perfectly watertight, it being possible for water to infiltrate across this enclosure through microfissures.

Document U.S. Pat. No. 4,188,157 describes a cryogenic liquid storage installation. This installation comprises a plurality of underwater storage cells.

The storage installation described in that document comprises a foundation base placed on the sea bed and on which a set of outer enclosures made of concrete housing liquefied natural gas (LNG) storage tanks rests.

The tanks are of the double-walled type. These walls comprise layers of concrete or steel and define an annular insulating space in which thermal insulation is placed.

Between each outer enclosure and the corresponding tank there remains an annular space of great thickness.

Water is circulated through the space between the concrete enclosure and the storage tank to enable a constant temperature to be maintained in this annular space. For that, the space between the concrete enclosure and the storage tank communicates freely with the outside.

SUMMARY OF THE INVENTION

It is an object of the invention to propose an underwater storage installation for liquefied natural gas which is of a simple and economical construction.

To this end, the subject of the invention is a storage installation of the aforementioned type, particularly an underwater storage installation for a cryogenic liquid. A foundation base rests directly on the sea floor. An underwater cell stores the cryogenics liquid and has cryogenic liquid-supply and -discharge conduits connected to it. The storage cell comprises a sealed outer chamber and a vapor barrier disposed inside the outer chamber and which defines a watertight space. There is a separation space between the outer chamber and the vapor barrier. Spacers are disposed in that space to keep the chamber and the vapor barrier at a distance from one another. The installation can be used for the storage of liquefied natural gas.

Embodiments of the storage installation according to the invention are indicated herein:

BRIEF DESCRIPTION OF THE DRAWINGS

The invention will be better understood on reading the description which will follow, given solely by way of example and made with reference to the attached drawings, in which:

FIG. 5 is a view of detail V of FIG. 2, on a larger scale;

FIG. 5A is a view on a larger scale of detail VA of FIG. 5; and

DESCRIPTION OF A PREFERRED EMBODIMENT

Figure 1:
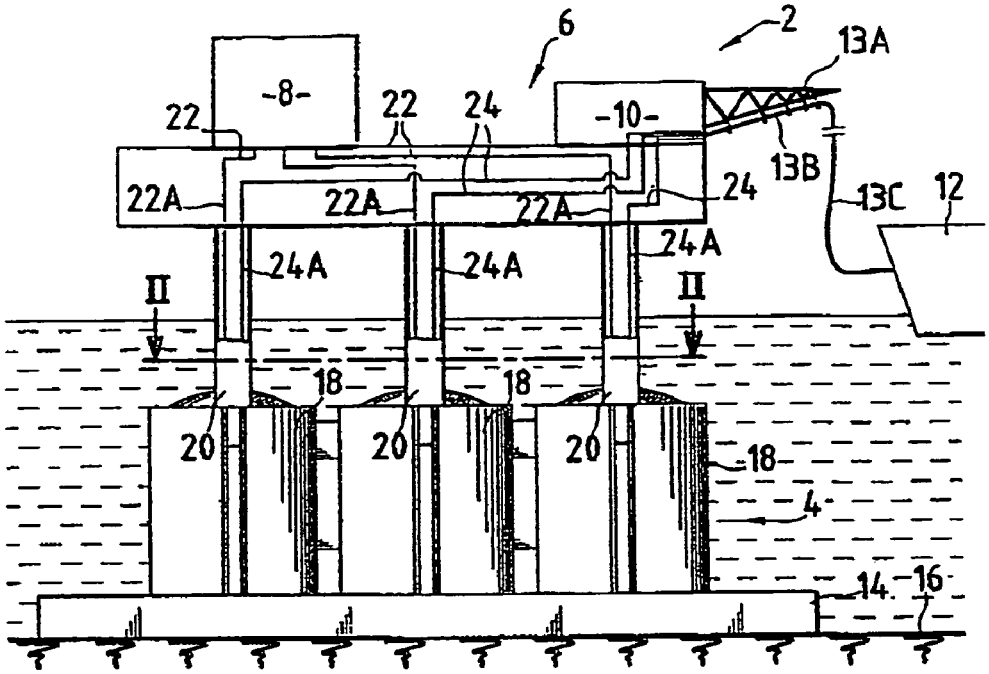
FIG. 1 is a schematic side view of a liquid natural gas storage installation according to the invention.

FIG. 1 depicts an installation for the production and underwater storage of liquefied natural gas, the installation being denoted by the general reference 2.

The installation 2 essentially comprises a storage set 4 and a production and transfer platform 6. The platform 6 is of known construction.

Arranged on the platform 6 are, on the one hand, an installation 8 for liquefying the natural gas, and, on the other hand, an installation 10 for transferring liquefied natural gas.

The natural gas liquefaction installation 8 is designed to liquefy natural gas in the gaseous state originating from a gas source, for example a natural gas reservoir (not depicted).

The liquefied natural gas transfer installation 10 is designed to transfer liquefied gas to a transport ship 12, for example a methane tanker. This installation 10 may comprise a jib 13A along which there runs a rigid pipe 13B, connected to a flexible pipe 13C for connection with the transport ship 12.

The installation 2 comprises a foundation base 14. The storage set 4 is placed on this foundation base 14 of the platform 6, which base rests directly on the sea bed 16. The storage set 4 comprises six liquefied natural gas storage cells 18 and six platform support columns 20 (other numbers and arrangements of storage cells may be envisaged).

The six storage cells 18 are arranged in two rows of three cells and rest on the foundation base 14.

The installation 2 is also equipped with connecting pipes. These pipes comprise supply pipes 22 leading from the liquefaction installation 8 to the storage cells 18 and discharge pipes 24 leading from the storage cells 18 to the transfer installation 10. The supply pipes 22 are designed to fill the storage cells 18 with liquefied natural gas.

As illustrated in FIG. 1, each supply pipe 22 comprises a vertical section 22A and each discharge pipe 24 comprises a vertical section 24A.

Figure 3:
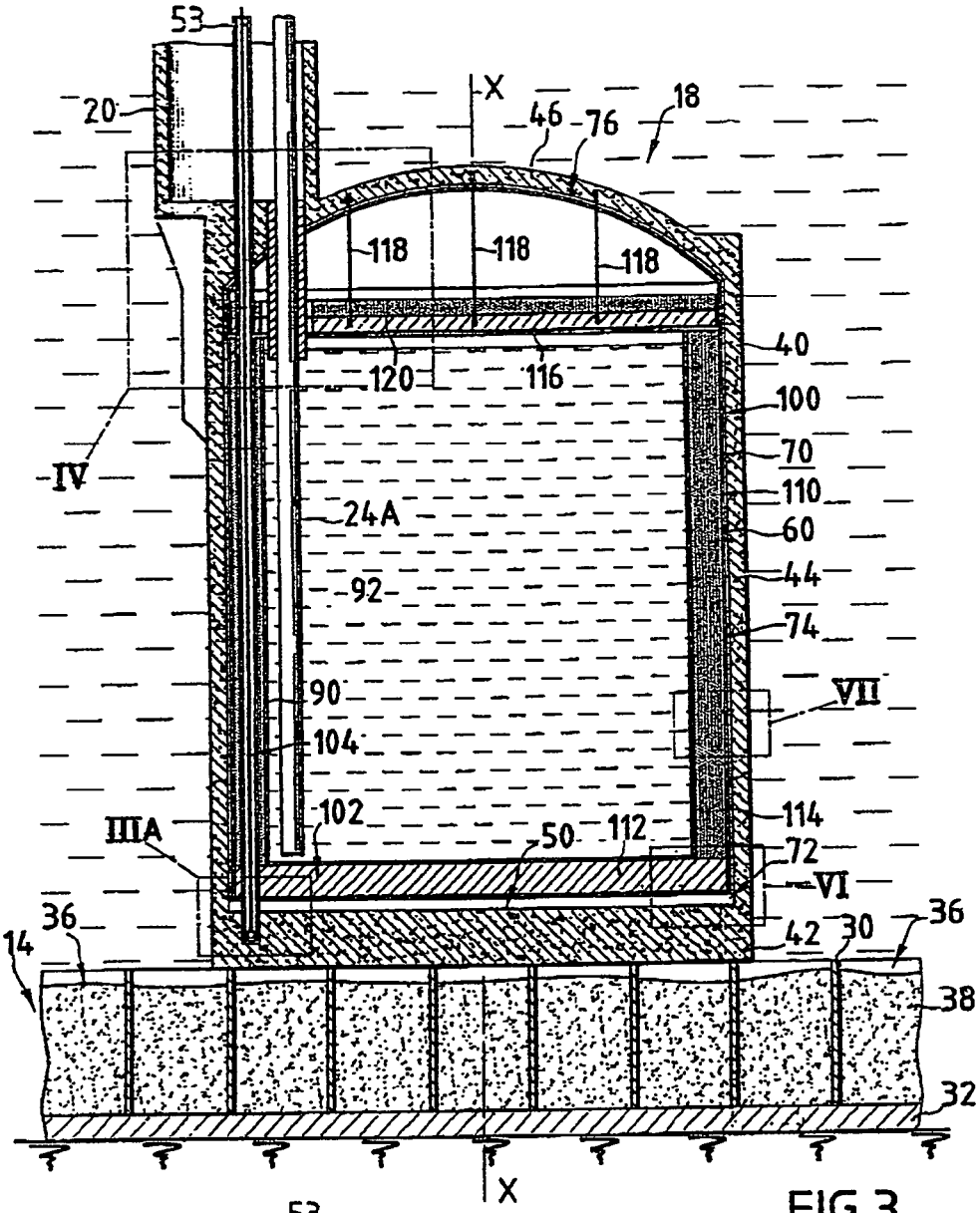
FIG. 3 is a view in section of a liquefied natural gas storage cell of the installation according to the invention, the section being taken on IV-IV of FIG. 2.
Figure 3A:
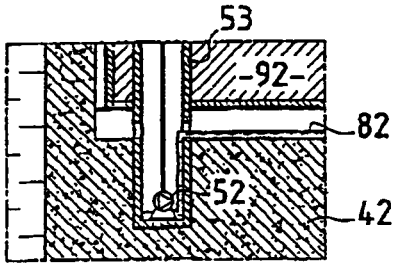
FIG. 3*a* is a view on a larger scale of detail IIIA of FIG. 3.

As illustrated in FIG. 3, the foundation base 14 is made up of a network of vertical walls forming a square or rectangular mesh structure 30 supported by a slab 32. Thus, the foundation base 14 delimits a plurality of compartments 36 designed to accommodate ballast, for example sand 38 or iron ore.

The storage cells 18 are fixed to the foundation base 14.

Each of the support columns 20 is a steel or concrete tube running from the peripheral edge of the upper part of the storage cell 18 vertically upwards, to above water level.

Figure 2:
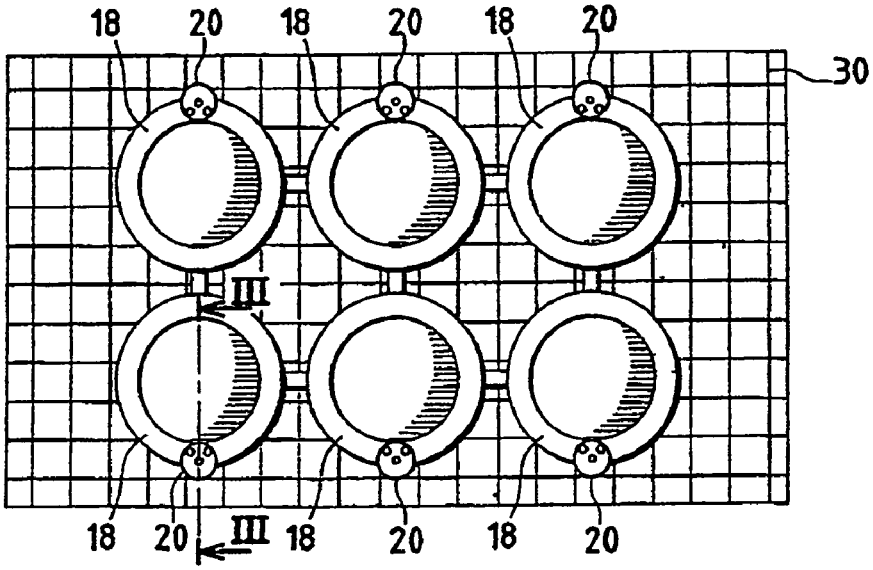
FIG. 2 is a view in section on II-II of FIG. 1.

As depicted in FIG. 2, each of the support columns 20 is arranged on the respective storage cell 18 on one side of this storage cell 18 which is the opposite side to a storage cell 18 of the adjacent row. Thus, the support columns 20, viewed in plan, are very widely separated, and this gives the platform 6 good stability.

FIG. 3 depicts a liquefied natural gas storage cell 18 according to the invention in greater detail.

The storage cell 18 comprises a concrete outer enclosure 40, preferably made of prestressed concrete, which forms the exterior surface of the storage cell 18. The enclosure 40 defines a protective and almost watertight enclosure; sea water could actually infiltrate across its wall. The enclosure 40 exhibits symmetry of revolution about a vertical axis X-X and comprises a lower part 42, a middle part 44 and an upper part 46.

The middle part 44 has the overall shape of a hollow cylinder of circular cross section, and the upper part 46 forms a dome in the shape of a cap of a sphere.

The storage cell 18 further comprises a vapor barrier 60 which completely seals the storage cell 18. This vapor barrier 60 is formed of a layer of carbon steel sheet which extends some distance from the interior surface of the enclosure 40, delimiting a first annular space 70. The annular space 70 comprises a horizontal lower part 72, a vertical annular middle part 74 and an upper part 76. The width of the annular space 70 is of the order of 5 to 20 mm.

Spacer pieces 80 in the form of cords of plastic, particularly of thermoset resin, are arranged in this first space 70.

The spacer pieces 80 comprise cords 82 arranged horizontally in the lower part 72, radially with respect to axis X-X.

The spacer pieces 80 also comprise cords 84 extending in the middle part 74 of the space. The cords 84 are arranged vertically and extend over the entire height of the middle part 74. The cords 84 are uniformly spaced (see FIG. 5).

The spacer pieces 80 form drainage spaces 88 (cf. FIG. 5) designed to discharge the sea water that might possibly enter via the walls of the enclosure 40 toward the discharge well 50. These drainage spaces are free of material. Thus, the vapor barrier 60 is protected against corrosion from any sea water that might enter via the walls of the enclosure 40. The thickness of the vapor barrier 60 may therefore be reduced to a minimum. It may be of the order of 4 to 8 mm, and there will be no need to provide additional thickness to compensate for corrosion.

This protecting of the vapor barrier 60 against corrosion allows the thermal insulation located in the annular space 100 to be protected against the ingress of sea water.

A circumferential channel extends along the lower part 42 of the storage cell 18 allowing any water originating from the drainage spaces to be collected. One or more drainage sumps are formed in the lower part 42 in line with the annular thermal insulation space 100 and vertically in line with the column 20. This configuration allows a drainage pump 52 to be installed through a duct 53 situated within the column and rising up to the surface platform. Drainage pump maintenance is thus simplified because these pumps can be raised directly up through the associated pipes.

As an alternative, the discharge sump 50 could have the shape of a funnel which would allow the drained water to be collected at a precise point in the lower part 42 of the storage cell 18.

A tank 90, containing liquefied natural gas 92, is placed inside the storage cell 18. The tank 90 has a hollow cylindrical overall shape and is open at the top. The self-supporting cylindrical tank 90 is made for example of special cryogenic steel. Together with the vapor barrier 60 of the storage cell it defines a second separating space 100 in which the necessary thermal insulation is placed. This separating space 100 comprises a cylindrical lower part 102 and an annular middle part 104. The width of the separating space 100 will be of the order of one meter.

The storage cell 18 comprises thermal insulation means 110. These thermal insulation means 110 comprise rigid cellular-glass panels 112 arranged in the lower part 102 of the second space, and perlite 114 placed in the middle part 104.

The thermal insulation means 110 further comprise a circular plate 116 (see FIGS. 3 and 4) extending over the opening of the tank 90. The circular plate 116 is made of an aluminum structure not impervious to the natural gas. The plate 116 is suspended from the dome 46 of the enclosure 40 by means of rods 118. When the tank 90 is full, the plate 116 is approximately 50 cm above the top surface of the liquefied natural gas. A thermal insulation 120, for example perlite or fiber glass or rock wool, is placed on the plate 116 to constitute an insulating plate protecting the upper space (hemispherical cap) from the cold temperatures and reducing thermal losses.

An annular gap 124 remains between the plate 116 and the tank 90, and this allows the gas pressures between the free volume of the tanks 90 situated underneath the plate 116 and the remainder of the storage cell 18 to be equalized.

It should be noted that the means of thermally insulating the storage cell 18 are chosen so that when the tank 90 is full of liquefied natural gas, the temperature at the exterior surface of the enclosure 40 is very close to the temperature of sea water, give or take one or two degrees.

Figure 4:
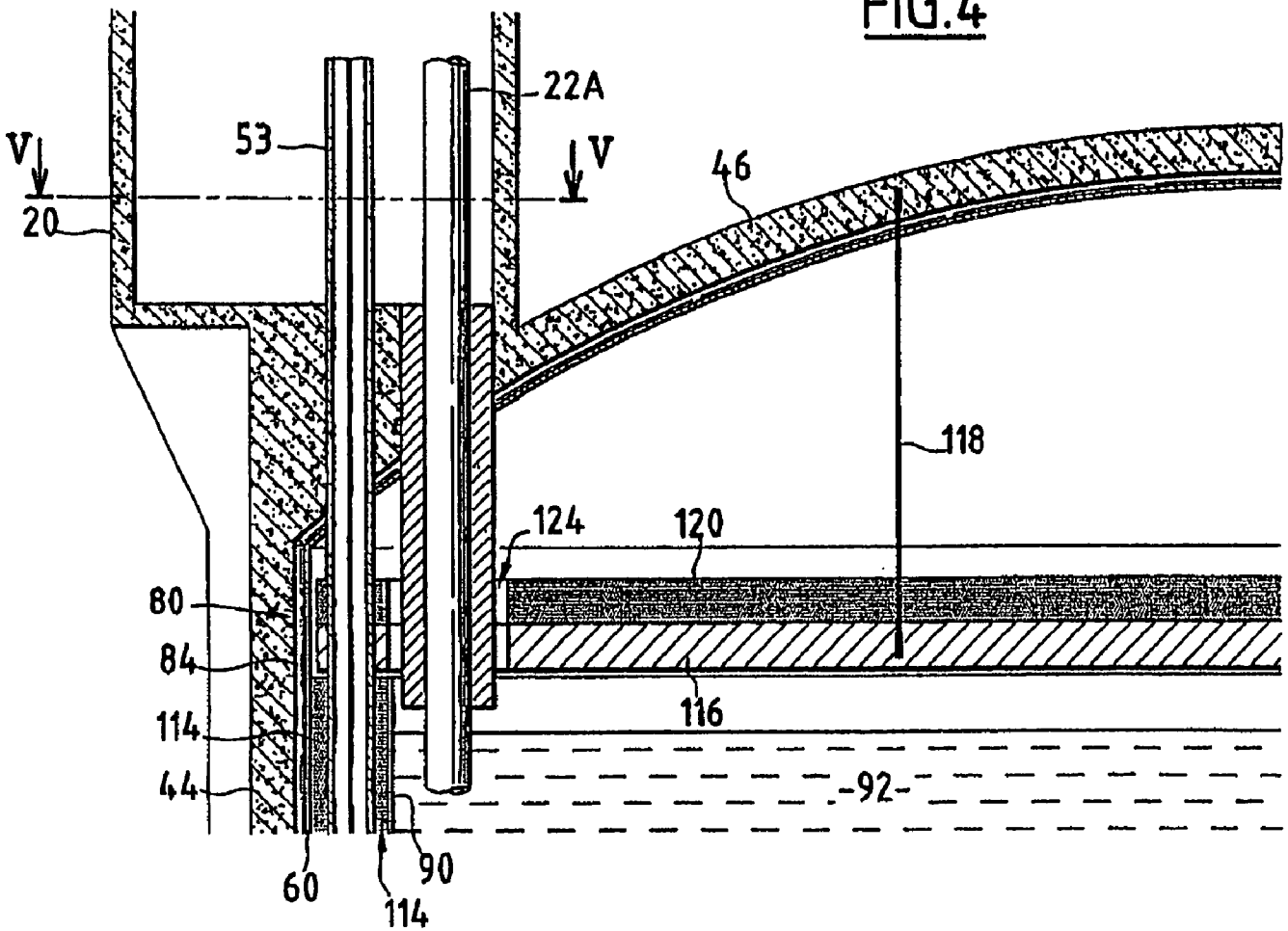
FIG. 4 is a view of detail IV of FIG. 3, on a larger scale.
Figure 6:
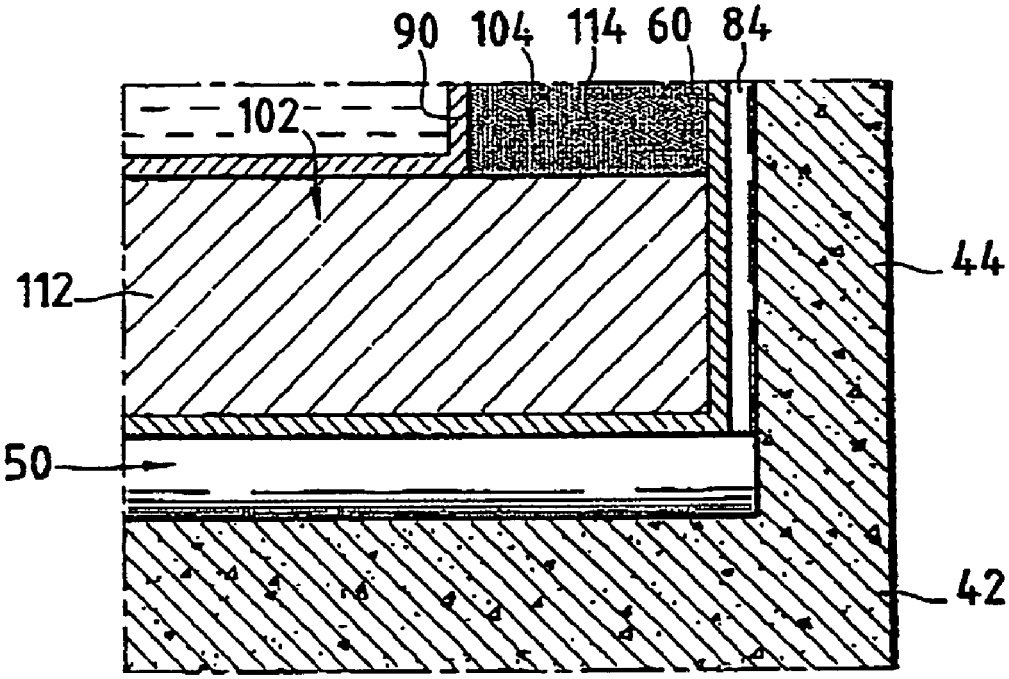
FIGS. 6 and 7 are detailed views on a larger scale of portions of the storage cell of FIG. 3.
Figure 7:
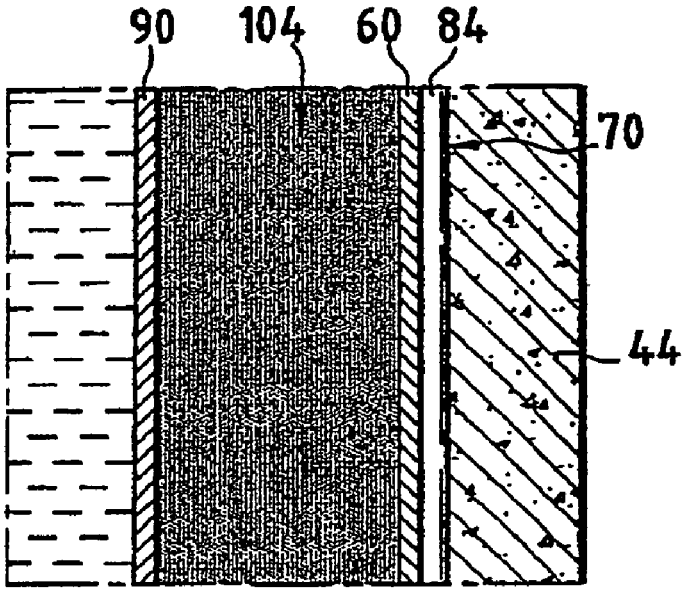

As illustrated in FIGS. 1, 4 and 5, each storage cell 18 comprises an individual set of supply 22 and. discharge 24 pipes.

In other words, arranged in each support column 20 are one or more supply pipes 22, one or more discharge pipes 24, and the other pipes allowing the storage facility to operate, such as those that allow the gas originating from the evaporation of the LNG to be discharged. The pipes 22, 24 run through the enclosure 40 and the thermal insulation of the cell 18 as far as the bottom of the tank 90.

The sections 22A, 24A of the supply and discharge pipes run vertically through the support columns 20, thus making it possible to simplify liquefied natural gas pump maintenance. This is because the pumps can thus be raised directly up through the discharge lines.

In addition, the support columns 20 protect these pipes against accidental knocks, dynamic stresses due to the swirl and to the current, and provide containment for any liquefied natural gas leak there might be within these support columns 20.

Finally, the diameter of these support columns 20 is of the order of 5 to 10 meters and the support column is vented to the atmosphere. Thus, maintenance of the supply 22 and discharge 24 pipes and of the storage cell 18 is simple because the support column 20 therefore offers freedom of access to the maintenance equipment and allows human intervention.

As an alternative, the storage cell 18 comprises means for placing the first separating space 70 under a protective atmosphere. These means comprise, for example, a reservoir of an inert gas connected to the separation space 70 by a pump and a pipe.

Thus, the annular space 70 may be filled with an inert gas, such as nitrogen, and this makes it possible to further reduce the risks of the vapor barrier 60 corroding.

In addition, the first annular space 70 may be equipped with means of detecting defective leaktightness of the vapor barrier 60. These means comprise, for example, a gas sensor sensing the gas stored in the tank, such as $CH_4$.

As a an alternative, these detection means comprise a pressure or pressure-variation sensor which measures the pressure or the variation in the pressure in the annular space 70. This sensor raises an alarm if a pressure or pressure-change threshold is crossed. The detection means may also comprise a methane-content detector if the installation is equipped with means for placing the annular space 70 under a protective atmosphere.

Thus, it is possible to detect defective leaktightness of the vapor barrier 60.

The drainage sump or sumps are equipped with water level detectors so that the drainage pumps can be switched on automatically.

As a further alternative, the installation comprises additional support columns (not depicted). These columns serve to stabilize the platform 6 and run either from the foundation base 14 toward the platform 6 or from the storage cells 18 toward the platform 6.

The invention claimed is:

1. An underwater sea bed storage installation for storing a cryogenic liquid, the installation comprising:

a base configured to rest on the sea bed;

a first underwater storage cell for storing the cryogenic liquid and connected to the base;

a support column rising from the first storage cell to above water level;

a platform mounted on the support column;

cryogenic liquid supply and discharge pipes running between the first storage cell and the platform;

the first storage cell comprising a closed outer enclosure, a vapor barrier positioned inside the outer enclosure and defining a watertight space inside the vapor barrier, the outer enclosure and the vapor barrier defining a first annular space between the outer enclosure and the vapor barrier;

spacer pieces arranged in the first annular space shaped and positioned to hold the outer enclosure and the vapor barrier, a first spacer piece of the spacer pieces spaced a distance from a second spacer piece of the spacer pieces;

drainage elements operable to drain off water entering and accumulating in the first annular space;

a self-supporting cryogenic liquid storage tank inside the vapor barrier, the storage tank being sized and shaped such that the storage tank and the vapor barrier define a second separating space between the storage tank and the vapor barrier; and thermal insulation positioned in the second separating space;

a second storage cell; and a second support column rising from the second storage cell, wherein the support column is positioned on a first side of the first storage cell that is opposite and away from a second side of the first storage cell that is toward the second storage cell.

2. The storage installation as claimed in claim 1, wherein the drainage elements comprise at least one drainage sump in a lower part of the outer enclosure, and a water discharge device connected to the drainage sump.

3. The storage installation as claimed in claim 1, wherein the vapor barrier is comprised of a metal sheet.

4. The installation as claimed in claim 3, wherein the vapor barrier is comprised of standard carbon steel without cryogenic properties.

5. The storage installation as claimed in claim 1, wherein the self-supporting storage tank is comprised of cryogenic steel.

6. The installation as claimed in claim 5, wherein the tank is comprised of 9% nickel or stainless steel.

7. The installation as claimed in claim 5, wherein the spacers are comprised of a thermoset resin.

8. The storage installation as claimed in claim 1, wherein the thermal insulation comprises perlite or glass wool.

9. The storage installation as claimed in claim 1, wherein the spacer pieces are comprised of plastic.

10. The installation as claimed in claim 1, further comprising for each of the storage cells a set of pipes, the set of pipes running along an inside of each of the storage cells and comprising at least one supply pipe and at least one discharge pipe for each storage cell.

11. The installation as claimed in claim 1, further comprising a transfer installation connected to the platform and operable to transfer cryogenic liquid from the platform to a transport ship.

12. The installation as claimed in claim 11, wherein the transfer installation comprises a jib connected to and operable to move with respect to the platform;

rigid pipes positioned along the jib; and a set of flexible pipes mounted at an end of the rigid pipes, wherein the set of flexible pipes is connectable to the transport ship.

13. The installation as claimed in claim,1 wherein the outer enclosure is comprised of concrete.

14. The installation as claimed in claim 1, wherein the second storage cell is identical in structure to the first storage cell.

* * * * *